US006003484A

United States Patent [19]

Vilou

[11] Patent Number: 6,003,484

[45] Date of Patent: Dec. 21, 1999

[54] DEVICE FOR CONTROLLING AN AUTOMOBILE VEHICLE STARTER MOTOR CONTACTOR

[75] Inventor: Gérard Vilou, Tassin, France

[73] Assignee: Valeo Equipment Electriques Moteur, Cretell, France

[21] Appl. No.: 09/041,900

[22] Filed: Mar. 13, 1998

[30] Foreign Application Priority Data

Mar. 14, 1997 [FR] France ..... 97 03090

[51] Int. Cl.[6] ..... F02N 11/08

[52] U.S. Cl. ..... 123/179.3; 290/38 R

[58] Field of Search ..... 123/179.3; 290/38 R, 290/38 C

[56] References Cited

U.S. PATENT DOCUMENTS

| | | | |
|---|---|---|---|
| 4,345,554 | 8/1982 | Hildreth et al. | 123/179.3 |
| 4,732,120 | 3/1988 | Naito et al. | 123/179.3 |
| 4,947,051 | 8/1990 | Yamamoto et al. | 290/38 R |
| 5,345,901 | 9/1994 | Siegnthaler et al. | 123/179.3 |
| 5,383,428 | 1/1995 | Fasola | 123/179.3 |
| 5,622,148 | 4/1997 | Xue et al. | 123/179.25 |
| 5,743,227 | 4/1998 | Jacquet et al. | 123/179.3 |
| 5,831,804 | 11/1998 | Vilou | 361/28 |
| 5,848,577 | 12/1998 | Sappe et al. | 123/179.3 |

FOREIGN PATENT DOCUMENTS

| | | |
|---|---|---|
| 2 311 191 | 12/1976 | France . |
| 2 626 417 | 7/1989 | France . |
| 1 538 338 | 1/1979 | United Kingdom . |

*Primary Examiner*—Tony M. Argenbright
*Assistant Examiner*—Arnold Castro
*Attorney, Agent, or Firm*—Morgan & Finnegan L.L.P.

[57] ABSTRACT

A device for controlling an automobile vehicle starter motor contactor having a power contact controlling the supply of power to the electric motor of the starter motor and at least one coil controlling the movement of said contact, one of the coils of said contactor being connected between the power supply terminal at the battery voltage and the electric motor, said device including a control unit for the starter motor and a transistor controlled by said unit that controls the supply of power to the coil or coils of the contactor, wherein the control unit includes means for turning off the transistor if the voltage at a given point between the coil and the motor is not greater than a predetermined threshold at the end of a predetermined time period from the starter switch of the vehicle closing.

17 Claims, 2 Drawing Sheets

DEVICE FOR CONTROLLING AN AUTOMOBILE VEHICLE STARTER MOTOR CONTACTOR

The present invention relates to devices for controlling automobile vehicle starter motor contactors.

BACKGROUND OF THE INVENTION

FIG. 1 shows a starter motor D which includes an electric motor M connected between ground and a power supply terminal B+ at the battery voltage.

A contactor 1 connected between said terminal B+ and the electric motor M controls the supply of power to the motor.

The contactor 1 is a relay with a moving core (not shown) actuated by an actuator coil 2 and a latching coil 3 respectively for pushing a power contact 1*a* into a closed position and for holding it there.

The actuator coil 2 is connected between the coil 3 and the side of the motor M that is not connected to ground. The opposite end of said coil 3 is connected to ground.

At their common end, the coils 2 and 3 are connected to the source of a transistor 4, the drain of which is connected to the terminal B+ via the starter switch 6.

A microprocessor 5 also connected to the power supply terminal B+ applies a control voltage to the gate of the transistor 4 to control the transistor 4 on an on/off basis, for example. As shown in FIG. 1, for example, the microprocessor 5 is integrated with the relay 1 and the transistor 4 in the starter motor casing. It can equally well be external of the starter motor, anywhere on the vehicle.

When said transistor 4 turns on, both the actuator coil 2 and the latching coil 3 are energized simultaneously.

To obtain a high actuation force, the actuator coil 2 has a much lower resistance than the latching coil 3. Since the resistance of the electric motor M when stationary is negligible compared with the resistance of the coils 2 and 3, the current flowing through said transistor 4 is at a maximum as long as the contactor 1 is not closed. This causes intense and fast heating of the transistor 4.

The forces generated by the coils 2 and 3 of the contactor move the core which closes the power contact 1*a* at the end of its travel.

The point 7 between the coil 2, the motor M and the contact 1*a* is then at the B+ potential. The coil 2 then draws virtually no current since both its ends are very close to the supply voltage at the terminal B+.

The transistor 4 then energizes only the latching coil 3, which draws little current, so heating of said transistor 4 is considerably reduced.

However, the power contact 1*a* may be prevented from closing properly, for example because of particles of insulative material on the faces of the contact 1*a* or because of mechanical jamming of components of the relay. The coil 2 is then energized continuously via the transistor 4 because its end connected to the motor M (point 7) remains at a potential close to ground potential.

The transistor 4 is then very quickly destroyed by overheating.

OBJECTS AND SUMMARY OF THE INVENTION

An aim of the invention is to alleviate this drawback.

To this end the invention proposes a device for controlling an automobile vehicle starter motor contactor having a power contact controlling the supply of power to the electric motor of the starter motor and at least one coil controlling the movement of said contact, one of the coils of said contactor being connected between the power supply terminal at the battery voltage and the electric motor, said device including a control unit for the starter motor and a transistor controlled by said control unit that controls the energizing of the coil or coils of the contactor, wherein the control unit includes means for turning off the transistor if the voltage at a given point between the coil and the motor is not greater than a predetermined threshold at the end of a predetermined time period from the starter switch of the vehicle closing.

The above device advantageously has the following additional features alone or in any possible combination:

- the control unit is a microprocessor which receives at the input of an analog-to-digital converter the voltage at said point between said coil and said electric motor;
- the control unit controls the transistor on an on/off basis; and
- the control unit controls the transistor so that the coil or coils of the contactor are energized progressively.

The invention also provides a device for controlling the supply of power to an automobile vehicle starter motor that includes a contactor having a power contact that controls the supply of power to the electric motor of the starter motor and at least one coil that controls the movement of said contact, the device further including a contactor control device of the above type.

The invention also provides a starter motor integrating a control device of the above kind.

BRIEF DESCRIPTION OF THE DRAWING

Other features and advantages of the invention will emerge from the following description. The description is purely illustrative and not limiting on the invention. It must be read with reference to the appended drawing, in which.

MORE DETAILED DESCRIPTION

Figure 1:
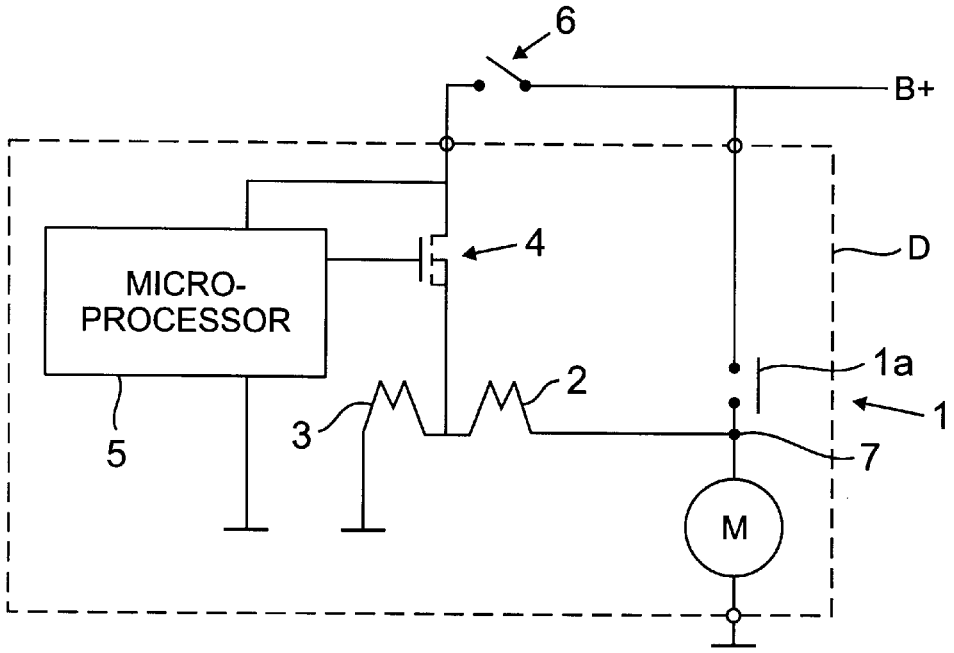
FIG. 1, described above, is a diagram showing a starter motor including an electronic control device.
Figure 2:
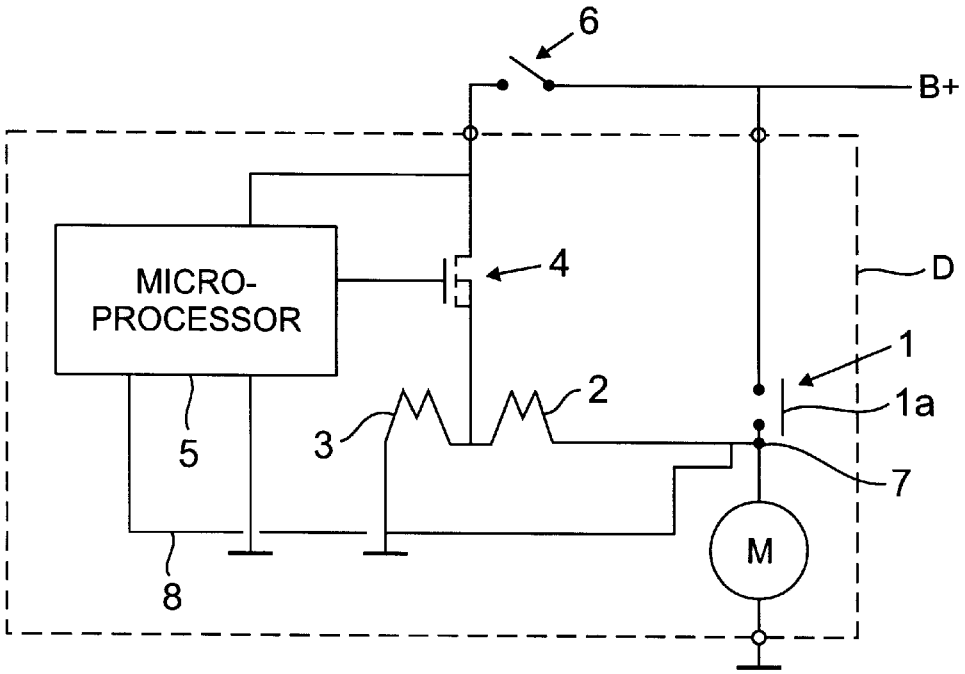
FIG. 2 is a diagram similar to that of FIG. 1, showing a starter motor including a control device constituting an embodiment of the invention.

The starter motor shown in FIG. 2 has a structure analogous to that shown in FIG. 1 and additionally includes a connection 8 between the point 7 common to the motor M and to the coil 2 and an analog-to-digital converter at the input of the microprocessor 5.

The connection 8 feeds the voltage at said point 7 to the microprocessor 5.

The microprocessor 5 operates as follows.

Figure 3:
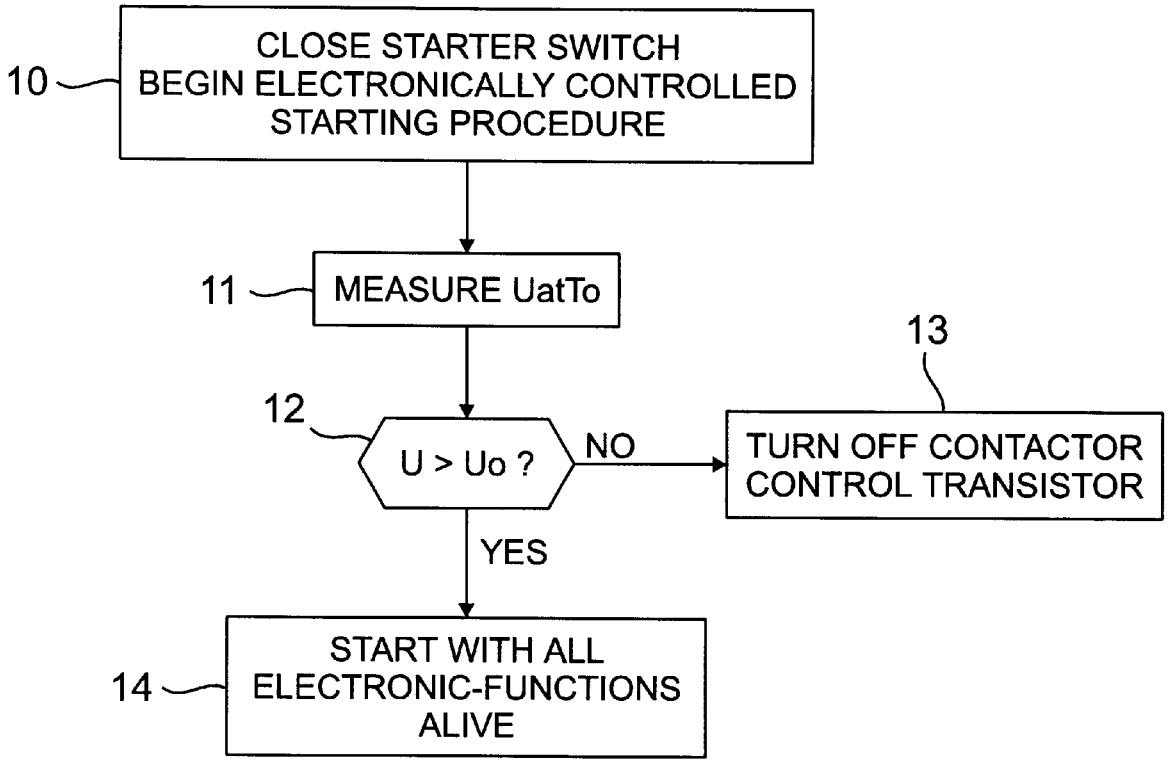
FIG. 3 is a flowchart showing various steps implemented by the microprocessor of the FIG. 2 device.

When it detects a voltage at its input connected to the terminal B+ (i.e. when it detects that the driver has closed the starter switch 6 of the vehicle) the microprocessor 5 applies a voltage to the gate of the transistor 4 to turn on said transistor 4 (step 10 in FIG. 3). The actuator and latching coils 2 and 3 are then energized.

At the end of a particular time period $T_1$ starting from the starter switch 6 closing, the microprocessor 5 determines the value U of the voltage at the point 7 (step 11) and compares this value to a given threshold value $U_0$ (test 12).

The threshold value $U_0$ is chosen to be characteristic of a positive voltage at the point 7 due to a current flowing through the actuator coil 2 and the motor M.

The value of $U_0$ is advantageously in the range 1 volt to 8 volts, for example.

The time period $T_1$ is chosen to be greater than the time period $T_0$ that normally elapses between the starter switch 6 of the vehicle closing and the power contact 1*a* closing. $T_0$ is usually in the range 20 milliseconds to 200 milliseconds.

If the voltage measured at time $T_1$ is not greater than this value $U_0$, then the microprocessor 5 turns off the transistor 4 by applying a null voltage to its gate (step 13).

The fact that the voltage at the point 7 has not reached the threshold value $U_0$ means that the power contact 1*a* is not closed, although it should be. If $T_1$ is chosen correctly, the starting process can be interrupted before the transistor 4 is damaged by overheating.

Of course, if the voltage at the point 7 is greater than $U_0$ at the end of the time period $T_1$ the microprocessor 5 continues the starting process (step 14).

The solution described above could of course be applied in the same manner if the transistor switched the current on a progressive basis rather than on an on/off basis, in which case the relay could include only one coil in place of an actuator coil and a latching coil.

Note also that the starter motor electronic control device shown in FIG. 1 has the advantage of being "self-contained", that is to say of not necessitating any electrical connection other than those used by conventional non-electronic starter motors, namely a control cable for connecting it to the starter switch of the vehicle, a power supply cable connected to a power supply terminal such as the positive terminal of the battery, and a ground return via the starter motor casing.

I claim:

1. A device for controlling an automobile vehicle starter motor contactor having a power contact controlling the supply of power to an electric motor of the starter motor and at least one coil controlling the movement of said contact, one of said at least one coil of said contactor being connected between a power supply terminal at the battery voltage and the electric motor, said device including a control unit for the starter motor and a transistor controlled by said control unit that controls the energizing of the at least one coil of the contactor, wherein the control unit includes means for turning off the transistor if the voltage at a given point between the coil and the motor is not greater than a predetermined threshold at the end of a predetermined time period from closure of a starter switch of the vehicle.

2. A device according to claim 1, wherein the control unit comprises a microprocessor having an analog-to-digital converter with an input, the microprocessor receiving at the input the voltage at said point between said coil and said electric motor.

3. A device according to claim 1, wherein the control unit controls the transistor on an on/off basis.

4. A device according to claim 1, wherein the control unit controls the transistor to energize the at least one coil of the contactor progressively.

5. A device for controlling the supply of power to an automobile vehicle starter motor that includes a contactor having a power contact that controls the supply of power to an electric motor of the starter motor and at least one coil for controlling the movement of said contact, the device further including a control device for the contactor according to claim 1.

6. A device according to claim 5, wherein the contactor includes an actuator coil and a latching coil.

7. An automobile vehicle starter motor integrating a power supply control device according to claim 5.

8. A starter motor comprising:

an electric motor;

a power contact for connecting the electric motor to a power supply terminal;

a coil for controlling movement of the power contact;

a transistor for controlling the energizing of the at least one coil;

a control unit for controlling the transistor, the control unit comprising means for determining whether the power contact is closed after energizing of the coil and means for turning off the transistor if the power contact is not closed after energizing of the coil.

9. The starter motor of claim 8, wherein the means for turning off the transistor turns off the transistor when the voltage at a given point between the coil and the motor is not greater than a predetermined threshold at the end of a predetermined time period after closure of a vehicle starter switch.

10. The starter motor of claim 9, wherein the control unit comprises a microprocessor.

11. A starter motor comprising:

an electric motor;

a power contact for connecting the electric motor to a power supply terminal;

a transistor having a drain for connection to the power supply terminal through a starter switch, a source and a gate;

a coil for controlling the power contact, the coil having a first end connected to the source of the transistor and a second end connected to the electric motor; and a microprocessor having an output connected to the gate of the transistor to control the operation of the transistor, a first input for connection to the power supply terminal through the starter switch, the transistor being turned on by the microprocessor after closure of the starter switch, thereby energizing the coil to cause closure of the power contact, a second input electrically connected to a point between the coil and the motor to receive a signal indicative of the state of the power contact, and means for turning off the transistor a predetermined time period after closure of the starter switch if the power contact is not closed.

12. The starter motor of claim 11, wherein the means for turning off the transistor turns off the transistor if the signal received at the second input of the microprocessor is a voltage signal having a value greater than a predetermined threshold.

13. A method of controlling a vehicle starter motor contactor comprising:

turning on a transistor in response to the closure of a starter switch;

energizing a coil through the transistor;

causing closure of a power contact by the coil to provide power to the starter motor;

determining if the power contact is closed at a predetermined time after closure of the starter switch; and turning off the transistor if the power contact is not closed.

14. The method of claim 13, wherein the determining step comprises:

detecting the voltage at a point between the coil and the motor at the predetermined time after closing the switch; and comparing the detected voltage to a predetermined threshold at the predetermined time.

15. The method of claim 14, comprising turning off the transistor if the detected voltage is not greater than the predetermined threshold.

16. The method of claim 13, wherein the energizing step comprises turning on the transistor in one step.

17. The method of claim 13, wherein the energizing step comprises energizing the coil progressively.

* * * * *